US010003130B2

(12) United States Patent
Wong et al.

(10) Patent No.: US 10,003,130 B2
(45) Date of Patent: Jun. 19, 2018

(54) COMMUNICATION DEVICE WITH RECONFIGURABLE LOW-PROFILE ANTENNA ELEMENT

(71) Applicant: Acer Incorporated, New Taipei (TW)

(72) Inventors: Kin-Lu Wong, New Taipei (TW); Meng-Ting Chen, New Taipei (TW)

(73) Assignee: Acer Incorporated, New Taipei (TW)

( * ) Notice: Subject to any disclaimer, the term of this patent is extended or adjusted under 35 U.S.C. 154(b) by 17 days.

(21) Appl. No.: 15/403,077

(22) Filed: Jan. 10, 2017

(65) Prior Publication Data

US 2017/0149139 A1 May 25, 2017

Related U.S. Application Data

(63) Continuation of application No. 14/071,660, filed on Nov. 5, 2013, now abandoned.

(30) Foreign Application Priority Data

Jun. 27, 2013 (TW) ..... 102122988 A

(51) Int. Cl.

| | |
|---|---|
| ***H01Q 9/04*** | (2006.01) |
| ***H01Q 1/48*** | (2006.01) |
| ***H01Q 7/00*** | (2006.01) |
| ***H01Q 5/50*** | (2015.01) |
| ***H01Q 1/24*** | (2006.01) |

(52) U.S. Cl.

CPC ..... *H01Q 9/0421* (2013.01); *H01Q 1/242* (2013.01); *H01Q 1/48* (2013.01); *H01Q 5/50* (2015.01); *H01Q 7/00* (2013.01)

(58) Field of Classification Search

CPC ..... H01Q 9/0421; H01Q 5/50; H01Q 1/242; H01Q 1/48; H01Q 7/00

See application file for complete search history.

(56) References Cited

U.S. PATENT DOCUMENTS

| | | | | |
|---|---|---|---|---|
| 2004/0227678 | A1* | 11/2004 | Sievenpiper | H01Q 1/243 343/702 |
| 2009/0251383 | A1* | 10/2009 | Tani | H01Q 1/243 343/852 |
| 2011/0128200 | A1* | 6/2011 | Hossain | H01Q 7/00 343/745 |
| 2012/0154247 | A1* | 6/2012 | Braun | H01Q 9/40 343/876 |

(Continued)

FOREIGN PATENT DOCUMENTS

| | | |
|---|---|---|
| CN | 103151601 | 6/2013 |

*Primary Examiner* — Dieu H Duong
*Assistant Examiner* — Bamidele A Jegede
(74) *Attorney, Agent, or Firm* — JCIPRNET

(57) ABSTRACT

A communication device including a ground element and an antenna element is provided. The antenna element is disposed adjacent to an edge of the ground element, and a loop structure is formed by the antenna element and the edge of the ground element. The antenna element includes a first and a second metal portions, and a first and second switches. When the first switch is turned on and the second switch is turned off, the first metal portion, the second metal portion, a shorting metal portion and the first switch form a loop antenna with the ground element. When the second switch is turned on and the first switch is turned off, an inverted-F antenna is formed by the second metal portion.

7 Claims, 5 Drawing Sheets

(56) References Cited

U.S. PATENT DOCUMENTS

2012/0299785 A1* 11/2012 Bevelacqua ..... H01Q 9/42
343/702
2012/0313819 A1 12/2012 Li et al.

* cited by examiner

COMMUNICATION DEVICE WITH RECONFIGURABLE LOW-PROFILE ANTENNA ELEMENT

CROSS-REFERENCE TO RELATED APPLICATION

This application is a continuation application of and claims the priority benefit of U.S. application Ser. No. 14/071,660, filed on Nov. 5, 2013, now pending. The prior application Ser. No. 14/071,660 claims the priority benefit of Taiwan application serial no. 102122988, filed on Jun. 27, 2013. The entirety of each of the above-mentioned patent applications is hereby incorporated by reference herein and made a part of this specification.

BACKGROUND

1. Field of the Disclosure

The present disclosure generally relates to a communication device, and more particularly, to a communication device with a reconfigurable low-profile antenna element.

2. Description of Related Art

Mobile communication devices have been rapidly developed in recent years. In order to provide multiple functions to consumers, a mobile communication device not only is demanded to meet the slim-type design, but also is disposed many components for implementing the related functions to fulfil the consumers' requirement. Therefore, how to utilize limited space to design a multi-function antenna element used for a mobile communication service in nowadays and improve the antenna element to achieve the performance required for practical use has become a major issue.

SUMMARY OF THE DISCLOSURE

The present disclosure provides a communication device that includes a reconfigurable low-profile antenna element, and the antenna element has a low profile and a small size and is operated in multiple bands to cover the LTE/WWAN bands.

The present disclosure provides a communication device including a ground element, an antenna element. The antenna element is disposed adjacent to an edge of the ground element and a loop structure is formed by the antenna element and the edge of the ground element. The antenna includes a first metal portion, a second metal portion, a first switch and a second switch. The first metal portion has a first end and a second end. The first end is a first feeding point of the antenna element, and the first feeding point is electrically connected to a communication module through a capacitive element. The second metal portion has a third end and a fourth end. The fourth end is electrically connected to the ground element through a shorting metal portion. The second metal portion further has a second feeding point, and the second feeding point is disposed away from the third end of the second metal portion and close to the fourth end of the second metal portion. The first switch is electrically connected between the second end of the first metal portion and the third end of the second metal portion. The first metal portion, the first switch and the second metal portion are arranged along a direction parallel to the edge of the ground element. The second switch is electrically connected between the second feeding point of the second metal portion and the communication module, and parallel to the shorting metal portion. When the first switch is turned on and the second switch is turned off, the first metal portion, the second metal portion, the shorting metal portion and the first switch form a loop antenna with the ground element, such that power is fed to the loop antenna through the first feeding point, and the loop antenna is operated at a first band. When the second switch is turned on and the first switch is turned off, an inverted-F antenna is formed by the second metal portion, such that the power is fed to the inverted-F antenna through the second feeding point, and the inverted-F antenna is operated at a second band, frequency of the second band is larger than frequency of the first band.

These and other exemplary embodiments, features, aspects, and advantages of the disclosure will be described and become more apparent from the detailed description of exemplary embodiments when read in conjunction with accompanying drawings.

BRIEF DESCRIPTION OF THE DRAWINGS

The accompanying drawings are included to provide a further understanding of the disclosure, and are incorporated in and constitute a part of this specification.

The drawings illustrate embodiments of the disclosure and, together with the description, serve to explain the principles of the disclosure.

DESCRIPTION OF THE EMBODIMENTS

Figure 1:
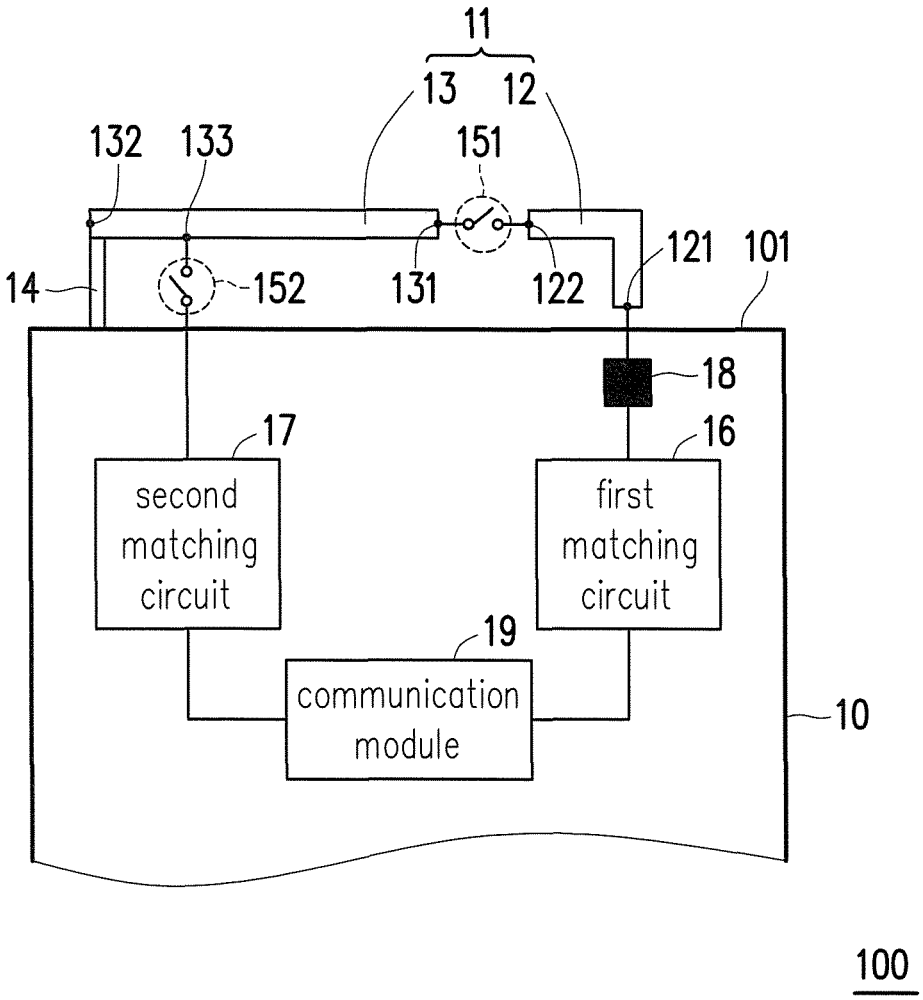
FIG. 1 is a structural schematic diagram showing a communication device according to an embodiment of the present disclosure.

FIG. 1 is a structural schematic diagram showing a communication device according to an embodiment of the present disclosure. As illustrated in FIG. 1, the communication device 100 includes a ground element 10 and an antenna element 11. The antenna element 11 is disposed adjacent to an edge 101 of the ground element 10 and a loop structure is formed by the antenna element 11 and the edge 101. The antenna element 11 includes a first metal portion 12 and a second metal portion 13. The first metal portion 12 has a first end 121 and a second end 122, and the first end 121 is a first feeding point of the antenna element 11. The second metal portion 13 has a third end 131 and a fourth end 132, and the second metal portion 13 further has a second feeding point 133 of the antenna element 11. The fourth end 132 of the second metal portion 12 is electrically connected to the ground element 10 through a shorting metal portion 14. In addition, the second feeding point 133 is disposed away from the third end 131 of the second metal portion 13 and close to the fourth end 132 of the second metal portion 13.

The communication device 100 further includes a first switch 151, a second switch 152, a capacitive element 18 and a communication module 19. The third end 131 of the second metal portion 13 is electrically connected to the second end 122 of the first metal portion 12 through the first switch 151. The first end 121 of the first metal portion 12 (i.e. the first feeding point) is electrically connected to the communication module 19 through the capacitive element 18. The second feeding point 133 of the second metal portion 13 is electrically connected to the communication module 19 through the second switch 152.

In terms of operation, the states of the first switch 151 and the second switch 152 is switched by the communication module 19, such that the antenna element 11 forms a loop antenna or an inverted-F antenna. Moreover, the communication module 19 transmits a signal to the first feeding point (i.e. the first end 121 of the first metal portion 12) or the second feeding point 133 in response to the states of the first switch 151 and the second switch 152, so as to excite the antenna element 11, such that the antenna element 11 is operated in a first band or a second band, and frequencies of the second band are higher than frequencies of the first band.

For instance, when the first switch 151 is turned on and the second switch 152 is turned off, the first metal portion 12, the second metal portion 13, the shorting metal portion 14 and the edge 101 of the ground element 10 form a loop antenna structure. In other words, when the first switch 151 is turned on and the second switch 152 is turned off, a loop antenna is formed by the antenna element 11, and the power is fed to the antenna element 11 through the first feeding point (i.e., the first end 121 of the first metal portion 121). Therefore, the communication module 19 transmits a signal to the first feeding point of the antenna element 11 through the capacitive element 18, such that the antenna element 11 is operated in the first band.

From another aspect, when the first switch 151 is turned off and the second switch 152 is turned on, the second metal portion 13 and the shorting metal portion 14 form an inverted-F antenna structure. In other words, when the first switch 151 is turned off and the second switch 152 is turned on, an inverted-F antenna is formed by the antenna element 11, and the power is fed to the antenna element 11 through the second feeding point 133. Therefore, the communication module 19 transmits the signal to the second feeding point 133 of the antenna element 11 through the turned-on second switch 152, such that the antenna element is operated in the second band.

It should be noted that, the communication device 100 may increase the bandwidth of the operating band of the antenna element 11 by employing at least one matching circuit. For example, as illustrated in FIG. 1, the communication device 100 further includes a first matching circuit 16 and a second matching circuit 17 in an embodiment. The first matching circuit 16 is electrically connected between the capacitive element 18 and the communication module 19, and the second matching circuit 17 is electrically connected between the second switch 152 and the communication module 19. When the antenna element 11 is operated in the first band, the first matching circuit 16 is employed for improving the impedance matching of the first band, so as to further increase the bandwidth of the first band. In addition, when the antenna element 11 is operated in the second band, the second matching circuit 17 is employed for improving the impedance matching of the second band, so as to further increase the bandwidth of the second band.

It's worth noting that, the antenna element 11 can be reconfigured to a loop antenna or to an inverted-F antenna. The inverted-F antenna is formed by a portion of the loop antenna, and the feeding structure of the inverted-F antenna (i.e. the second feeding point 133) is located inside of the loop antenna. That is to say, the size of the antenna element 11 is mainly determined by the loop antenna. Besides, the communication device 100 can reconfigure the antenna element 11 from the loop antenna to the inverted-F antenna without increasing the total size of the antenna element 11.

On the other hand, the capacitive element 18 can effectively reduce the resonant length of the loop antenna, so as to assist on lowering the size of the antenna element 11. Moreover, comparing to the method of using the inductive element with high inductance to decrease the size of the antenna element at a fixed frequency, the method of using the capacitive element to decrease the size of the antenna element can avoid the high series ohmic loss caused by the inductive element with the high inductance, so as to further avoid decreasing the radiation efficiency of the antenna. From another aspect, since the main structure of the antenna element 11 is the loop antenna and the loop antenna does not has an open end during the operation, the antenna element 11 can have a low profile with small coupling between the antenna element 11 and the ground element 10, and that further facilitates the development of the slim-type communication device 100 by applying the disclosed antenna element of this invention.

Figure 2:
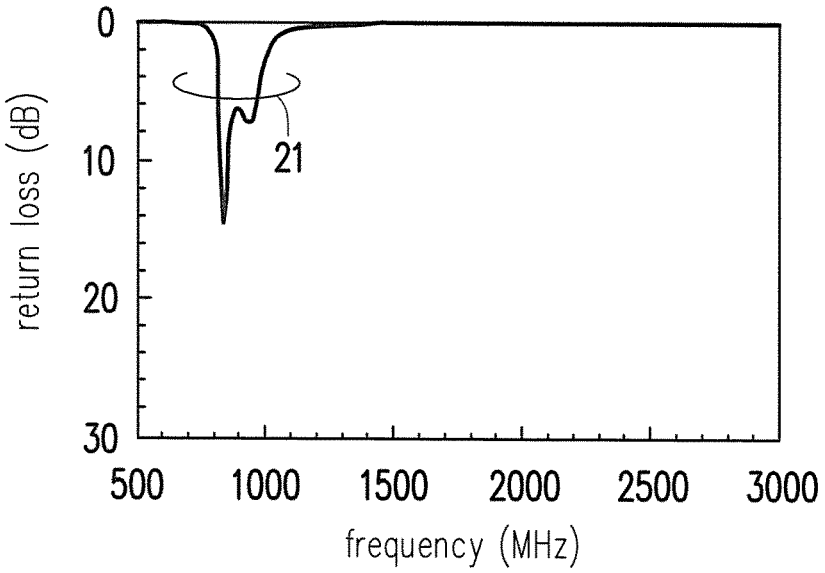
FIG. 2 is a diagram showing return loss when the power is fed to the antenna element through the first feeding point according to the embodiment of FIG. 1.

FIG. 2 is a diagram showing return loss when the power is fed to the antenna element through the first feeding point according to the embodiment of FIG. 1. In the present embodiment, the size of the ground element 10 is about 150×200 $min^e$ (which is approximately equal to a size of a ground element of a typical tablet communication device). In addition, the height of the antenna element 11 is about 8 mm, and the length of the antenna element 11 is about 35 mm. As shown in FIG. 2, when the first switch 151 is turned on and the second switch 152 is turned off, the first metal portion 12, the second metal portion 13 and the shorting metal portion 14 of the antenna element 11 form the loop antenna structure with the edge 101 of the ground element 10, such that the antenna element 11 is operated in a first band 21, wherein the first band 21 may cover the GSM850/900 bands.

Figure 3:
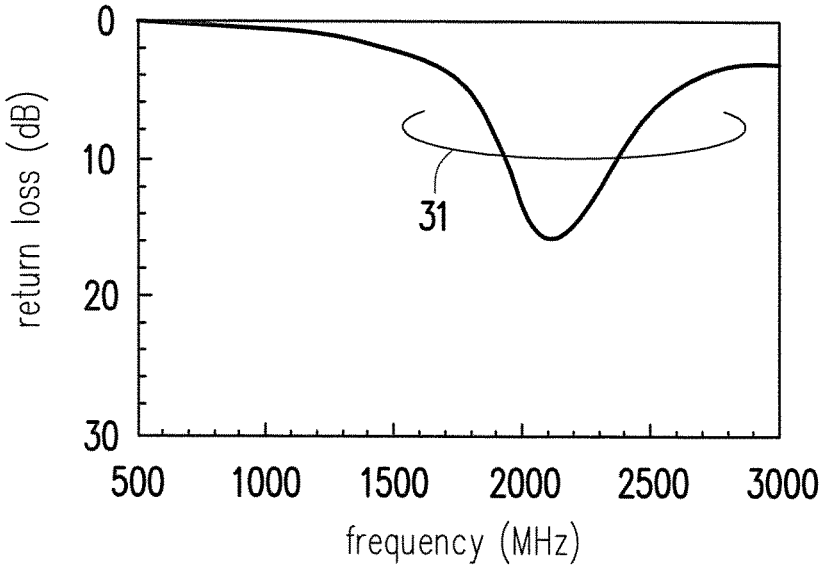
FIG. 3 is a diagram showing return loss when the power is fed to the antenna element through the second feeding point according to the embodiment of FIG. 1.

FIG. 3 is a diagram showing return loss when the power is fed to the antenna element through the second feeding point according to the embodiment of FIG. 1. As shown in FIG. 3, when the first switch 151 is turned off and the second switch 152 is turned on, the second metal portion 13 and the shorting metal portion 14 of the antenna element 11 from the inverted-F antenna structure, such that the antenna element 11 is operated in a second band 31, wherein the second band 31 may cover the GSM1800/1900/UMTS/LTE2300/LTE2500 bands.

Figure 4:
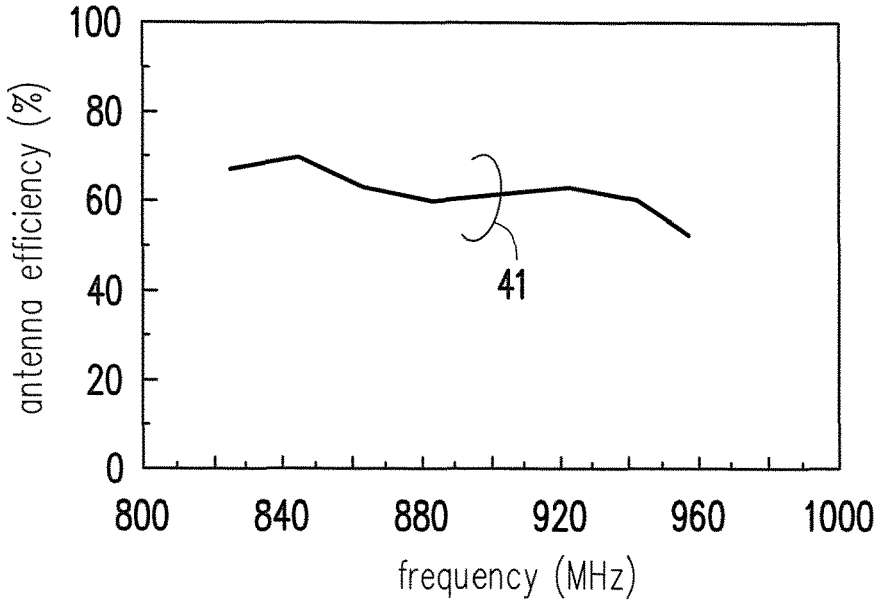
FIG. 4 is a diagram showing antenna efficiency when the power is fed to the antenna element through the first feeding point according to the embodiment of FIG. 1.

FIG. 4 is a diagram showing antenna efficiency when the power is fed to the antenna element through the first feeding point according to the embodiment of FIG. 1. As shown in FIG. 4, when the first switch 151 is turned on and the second switch 152 is turned off, an antenna efficiency curve 41 represents the antenna efficiency under the situation that the power is fed to the antenna element 11 through the first feeding point, and the antenna element is operated in the first band (such as GSM850/900 bands). Referring to the antenna efficiency curve 41, the antenna element 11 can have good antenna efficiency in the GSM850/900 bands to meet the practical applications.

Figure 5:
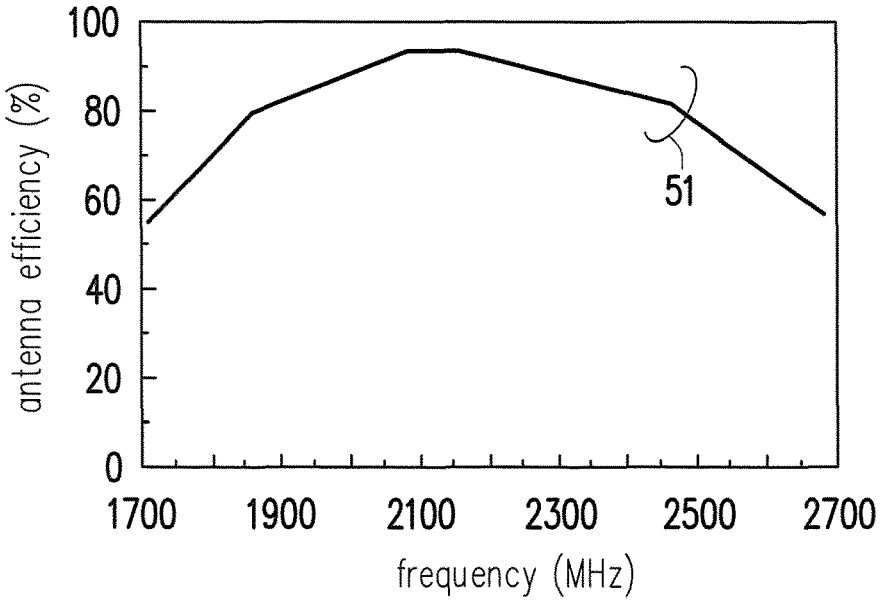
FIG. 5 is a diagram showing antenna efficiency when the power is fed to the antenna element through the second feeding point according to the embodiment of FIG. 1.

FIG. 5 is a diagram showing antenna efficiency when the power is fed to the antenna element through the second feeding point according to the embodiment of FIG. 1. As shown in FIG. 5, when the first switch 151 is turned off and the second switch 152 is turned on, an antenna efficiency curve 51 represents the antenna efficiency under the situation that the power is fed to the antenna element 11 through the second feeding point 133, and the antenna element 11 is operated in the second band (such as GSM1800/1900/UMTS/LTE2300/2500 bands). Referring to the antenna efficiency curve 51, the antenna element 11 can have good antenna efficiency in the GSM1800/1900/UMTS/LTE2300/2500 bands to meet the practical applications.

Figure 6:
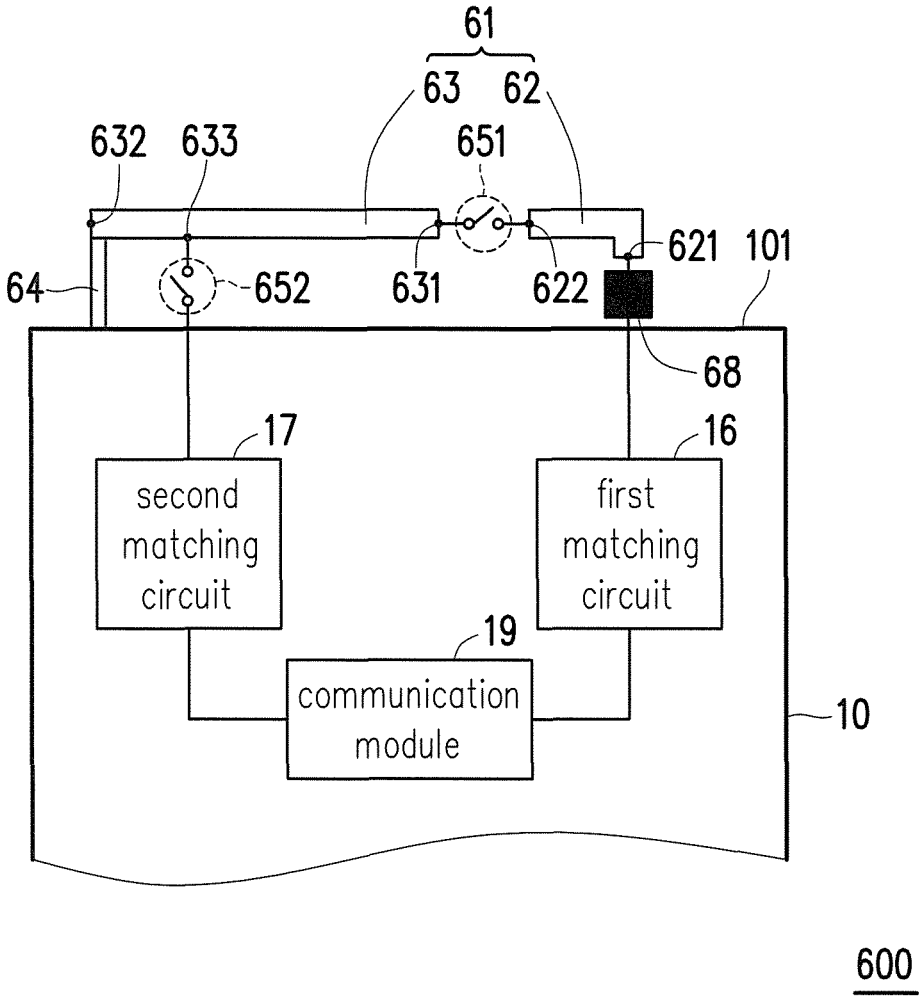
FIG. 6 is a structural schematic diagram showing a communication device according to another embodiment of the present disclosure.

FIG. 6 is a structural schematic diagram showing a communication device according to another embodiment of the present disclosure. The embodiment shown FIG. 6 is the extension of the embodiment shown in FIG. 1. In other words, the communication device 600 shown in FIG. 6 is basically the same as the communication device 100 shown in FIG. 1.

For instance, the antenna element 61 includes a first metal portion 62 and a second metal portion 63. A first end 621 of the first metal portion 62 is a first feeding point of the antenna element 61, and a second end 622 of the first metal portion 62 is electrically connected to a third end 631 of the second metal portion 63 through a first switch 651. In addition, a fourth end 632 of the second metal portion 63 is electrically connected to a ground element 10 through a shorting metal portion 64, and a second feeding point 633 of the second metal portion 63 is electrically connected to the communication module 19 through a second switch 652.

The difference between the embodiment of FIG. 1 and the embodiment of FIG. 6 is that, the capacitive element 68 in FIG. 6 is disposed in a clearance area above the ground element 10, and the capacitive element 68 may be a chip capacitor or a distributed capacitive element. Under the similar structure, the communication device 600 shown in FIG. 6 can achieve the similar effect as the communication device 100 shown in the embodiment of FIG. 1.

Figure 7:
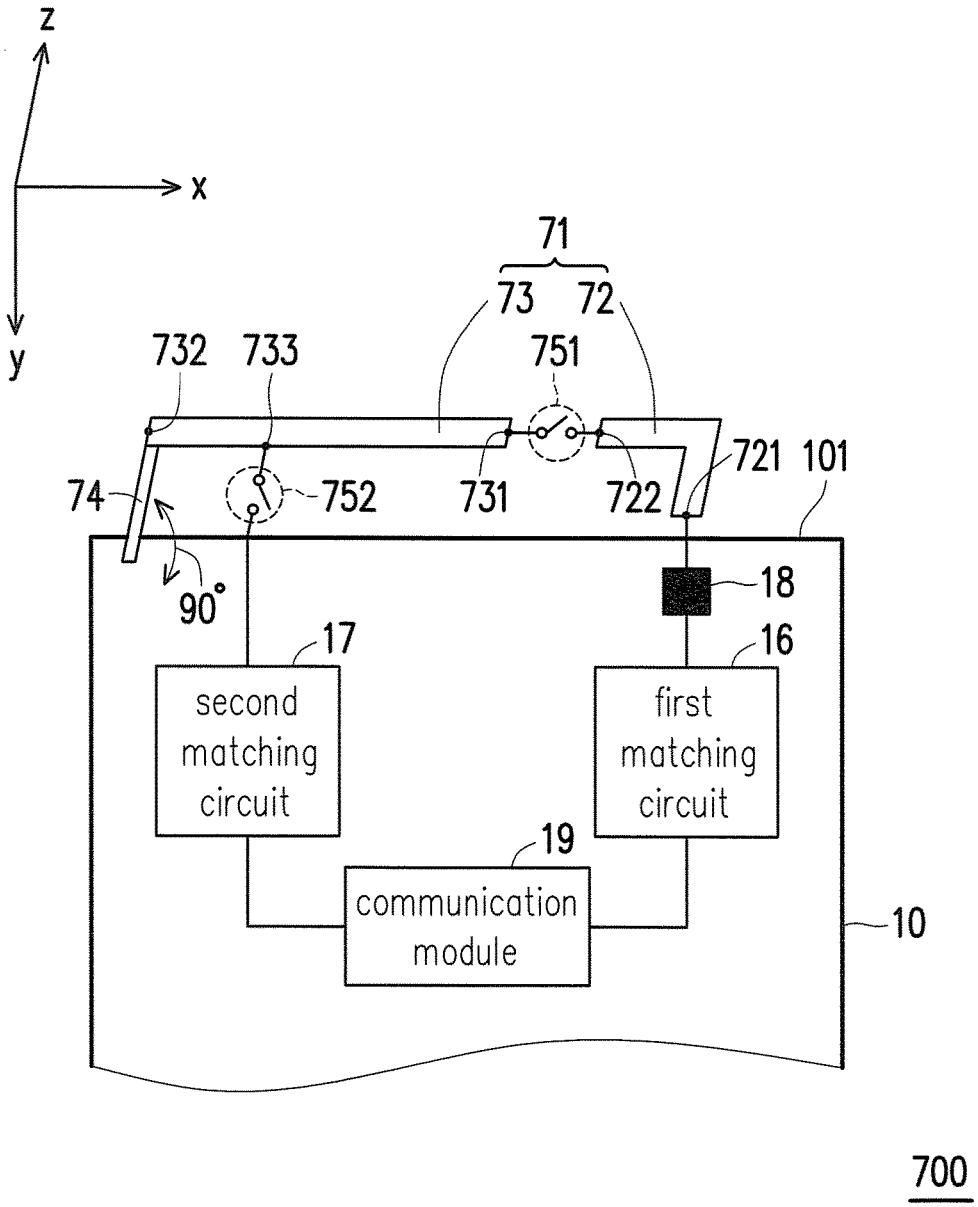
FIG. 7 is a structural schematic diagram showing a communication device according to still another embodiment of the present disclosure.

FIG. 7 is a structural schematic diagram showing a communication device according to still another embodiment of the present disclosure. The embodiment shown in FIG. 7 is the extension of the embodiment shown in FIG. 1. In other words, the communication device 700 shown in FIG. 7 is basically the same as the communication device 100 shown in FIG. 1.

For instance, the antenna element 71 includes a first metal portion 72 and a second metal portion 73. A first end 721 of the first metal portion 72 is a first feeding point of the antenna element 71, and a second end 722 of the first metal portion 72 is electrically connected to a third end 731 of the second metal portion 73 through a first switch 751. In addition, a fourth end 732 of the second metal portion 73 is electrically connected to a ground element 10 through a shorting metal portion 74, and a second feeding point 733 of the second metal portion 73 is electrically connected to the communication module 19 through a second switch 752.

The difference between the embodiment of FIG. 1 and the embodiment of FIG. 7 is that, a plane where the antenna element 11 is located (shown in FIG. 1) is substantially parallel to the ground element 1 and the antenna element 11 is not overlapped with the ground element 10, whereas a plane where the antenna element 11 is located (shown in FIG. 7) is substantially perpendicular to the ground element 11 and the antenna element 11 is disposed adjacent to the edge 11 of the ground element 11. For example, as shown in FIG. 7, the plane where the antenna element 11 is located may be the Z-X plane and the ground element 10 is substantially parallel to the X-Y plane. Under the similar structure, the communication device 700 shown in FIG. 7 can achieve the similar effect as the communication device 100 shown in the embodiment of FIG. 1. Further, in the embodiment shown in FIG. 7, because the antenna element 11 does not occupy a clearance region on a plane where the ground element 10 is located, the antenna element 11 of the embodiment shown in FIG. 7 is applicable to be used in a communication device with metal back cover.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A communication device, comprising:

a ground element; and an antenna element, disposed adjacent to an edge of the ground element, wherein a loop structure is formed by the antenna element and the edge of the ground element, and the antenna element comprises:

a first metal portion, having a first end and a second end, wherein the first end is a first feeding point of the antenna element, and the first feeding point is electrically connected to a communication module through a capacitive element;

a second metal portion, having a third end and a fourth end, wherein the fourth end is electrically connected to the ground element though a shorting metal portion, wherein the second metal portion further has a second feeding point, and the second feeding point is disposed away from the third end of the second metal portion and close to the fourth end of the second metal portion;

a first switch, electrically connected between the second end of the first metal portion and the third end of the second metal portion, wherein the first metal portion, the first switch and the second metal portion are arranged along a direction parallel to the edge of the ground element; and a second switch, electrically connected between the second feeding point of the second metal portion and the communication module, and parallel to the shorting metal portion, wherein when the first switch is turned on and the second switch is turned off, the first metal portion, the second metal portion, the shorting metal portion and the first switch form a loop antenna with the ground element, such that power is fed to the loop antenna through the first feeding point, and the loop antenna is operated at a first band, wherein when the second switch is turned on and the first switch is turned off, an inverted-F antenna is formed by the second metal portion, such that the power is fed to the inverted-F antenna through the second feeding point, and the inverted-F antenna is operated at a second band, frequency of the second band is larger than frequency of the first band.

2. The communication device according to claim 1, wherein the communication module switches states of the first switch and the second switch, such that the antenna element forms the inverted-F antenna or the loop antenna.

3. The communication device according to claim 2, wherein the communication module transmits a signal to the first feeding point or the second feeding point in response to the states of the first switch and the second switch, such that the antenna element is operated in the first band or the second band.

4. The communication device according to claim 1, further comprising:

a first matching circuit, electrically connected between the capacitive element and the communication module; and a second matching circuit, electrically connected between the second switch and the communication module.

5. The communication device according to claim 1, wherein the capacitive element is a chip capacitor or a distributed capacitive element.

6. The communication device according to claim 1, wherein a plane, where the antenna element is located, is parallel to the ground element, and the antenna element is not overlapped with the ground element.

7. The communication device according to claim 1, wherein a plane, where the antenna element is located, is substantially perpendicular to the ground element and is disposed adjacent to the edge of the ground element.

* * * * *